US011414308B2

(12) United States Patent
Ferrer Morancho

(10) Patent No.: US 11,414,308 B2
(45) Date of Patent: Aug. 16, 2022

(54) STABILIZER LEG DEVICE

(71) Applicant: Hiab AB, Kista (SE)

(72) Inventor: Joaquin Ferrer Morancho, Saragossa (ES)

(73) Assignee: Hiab AB, Kista (SE)

( * ) Notice: Subject to any disclaimer, the term of this patent is extended or adjusted under 35 U.S.C. 154(b) by 383 days.

(21) Appl. No.: 16/615,323

(22) PCT Filed: May 18, 2018

(86) PCT No.: PCT/EP2018/063052

§ 371 (c)(1),
(2) Date: Nov. 20, 2019

(87) PCT Pub. No.: WO2018/215329

PCT Pub. Date: Nov. 29, 2018

(65) Prior Publication Data

US 2020/0156906 A1 May 21, 2020

(30) Foreign Application Priority Data

May 22, 2017 (EP) ..... 17172219

(51) Int. Cl.
*B66C 23/80* (2006.01)

(52) U.S. Cl.
CPC ..... *B66C 23/80* (2013.01); *B66C 2700/0378* (2013.01)

(58) Field of Classification Search
CPC .. B66C 23/80; B66C 23/78; B66C 2700/0378
See application file for complete search history.

(56) References Cited

U.S. PATENT DOCUMENTS 1,782,406 A * 11/1930 Bureau ..... B66C 23/78 212/301
2,844,348 A * 7/1958 Jordan ..... B60S 9/06 248/354.3

(Continued)

FOREIGN PATENT DOCUMENTS

| | | | |
|---|---|---|---|
| EP | 0945318 | A1 | 9/1999 |
| EP | 1586528 | A1 | 10/2005 |
| WO | 96/34782 | A1 | 11/1996 |

*Primary Examiner* — Erez Gurari
(74) *Attorney, Agent, or Firm* — Dilworth & Barrese, LLP

(57) ABSTRACT

A stabilizer leg device with a stabilizer leg to be moved down-wards from an object so as to stabilize the object by bearing through a foot plate (7) on the ground. The device comprises a first engagement member (20) arranged coaxially to a horizontal axis on a part (19) fixed in relation to the object, and a shaft (12) having a first end provided with a second engagement member (21) and an opposite second end arranged to be influenced by movement of a second stabilizer leg member in relation to a first stabilizer leg member to make the shaft slide along the stabilizer leg under extension and retraction of the stabilizer leg so as to cause pivoting of the stabilizer leg by a mutual engagement of said engagement members (20, 21). Members (16, 17) guiding the shaft are designed to automatically unlock and lock, respectively, the stabilizer leg with respect to possibility to pivot about said horizontal axis by passing a predetermined position by the second stabilizer leg member upon retraction and extension of the stabilizer leg.

20 Claims, 4 Drawing Sheets

(56) References Cited

U.S. PATENT DOCUMENTS

| | | | | | |
|---|---|---|---|---|---|
| 2,855,111 | A * | 10/1958 | McIntyre, Sr. | B66C 23/80 | 280/764.1 |
| 3,784,035 | A * | 1/1974 | Dunbar | B66C 23/78 | 212/302 |
| 4,176,824 | A * | 12/1979 | Linton | B60S 9/10 | 254/423 |
| 4,416,344 | A * | 11/1983 | Nakada | B66C 23/80 | 180/199 |
| 4,449,734 | A * | 5/1984 | Cory | B66F 3/30 | 254/93 A |
| 6,267,357 | B1 * | 7/2001 | Ebey | B60S 9/08 | 254/419 |
| 8,678,471 | B2 * | 3/2014 | McCarthy | B60P 3/32 | 296/156 |
| 2004/0197181 | A1 * | 10/2004 | Clark | B66C 23/005 | 414/729 |
| 2016/0185322 | A1 * | 6/2016 | Vierkotten | B66C 23/80 | 701/33.9 |
| 2016/0340156 | A1 * | 11/2016 | Ost | B66C 23/78 | |
| 2020/0122985 | A1 * | 4/2020 | Nylander | B60S 9/12 | |
| 2020/0156906 | A1 * | 5/2020 | Ferrer Morancho | B66C 23/80 | |
| 2020/0198944 | A1 * | 6/2020 | Nylander | B66C 23/80 | |
| 2020/0198945 | A1 * | 6/2020 | Kolenc | E02F 9/085 | |
| 2021/0261100 | A1 * | 8/2021 | Reyes | F16C 11/069 | |
| 2022/0032835 | A1 * | 2/2022 | Schwartzrock | B66C 23/54 | |

* cited by examiner

STABILIZER LEG DEVICE

TECHNICAL FIELD OF THE INVENTION AND BACKGROUND ART

The present invention relates to a stabilizer leg device with a stabilizer leg to be moved downwards from an object, such as a crane vehicle, so as to stabilize this object by bearing through a footplate secured to a lower end of the stabilizer leg onto a support layer on which the object is resting.

Such a stabilizer leg device is normally a part of a support arrangement fixed to such an object, such as a movable crane construction, by a frame structure to which one or more such stabilizer leg devices are secured for stabilizing the crane construction when this has to carry out work.

A stabilizer leg device of this type and with the features listed in the preamble of appended claim 1 is known through EP 0 945 318 A1. The use of first and second engagement members for obtaining a movement of the stabilizer leg from a working position of the stabilizer leg device with the footplate bearing on the ground to a parking position in which the footplate points upwards upon a retraction of the second stabilizer leg member in relation to the first stabilizer leg member, means that such a movement may be carried out by pivoting or tilting the stabilizer leg about a horizontal axis. It is then of course essential that the stabilizer leg in said working position is prevented from pivoting about said horizontal axis, and in said known device this is obtained by providing a mechanical lock realised by means of a locking pin. This locking pin has to be operated manually, which makes the locking and unlocking actions rather complicated to achieve. Furthermore, such a design has not an optimum reliability, since there is a risk that it is forgotten to carry out the locking action, which may then under extreme conditions result in accidents.

SUMMARY OF THE INVENTION

The object of the present invention is to provide a stabilizer leg device of the type discussed above being improved in at least some aspect in relation to such stabilizer leg devices already known.

This object is according to the invention obtained by providing such a stabilizer leg device with the features listed herein; and By providing the arrangement for controlling the movement of the stabilizer leg between the working position and the parking position with guiding members, pivoting of the stabilizer leg about said horizontal axis may automatically be prevented by guiding the shaft to slide vertically. Furthermore, by designing these guiding members to interrupt the guiding when the shaft reaches a predetermined position when retracting the stabilizer leg, the stabilizer leg will automatically be allowed to pivot about said horizontal axis for reaching the parking position. This combined with the fact that the second engagement member is positioned on the shaft to enter into engagement with the first engagement member when the second stabilizer leg member is reaching the predetermined position in a stabilizer leg retraction movement and to leave this engagement when reaching the predetermined position in a stabilizer leg extension movement means that the stabilizer leg will automatically be unlocked and locked, respectively, with respect to the possibility to pivot about the horizontal axis, by passing the predetermined position by the second stabilizer leg member. Thus, the locking and unlocking of the stabilizer leg will be obtained automatically upon said extension and retraction of the stabilizer leg without involving any manual work, which implies that these actions may be achieved in a simple and reliable manner.

According to an embodiment of the invention said first engagement member comprises an at least semi-circular member, such as a disc, which is fixed to said part coaxially to said horizontal axis and provided with cogs over at least a part of its circumference, and the shaft is provided with said second engagement member by being at least partially cogged so as to engage with the cogs of the first engagement member. This constitutes a simple and reliable way to accomplish the engagement causing the pivoting action. The cogs of the first engagement member may then according to another embodiment of the invention be provided by a disc in the form of a gearwheel provided with cogs over at least a part of the circumference thereof.

According to another embodiment of the invention the second end of the shaft is connected to the second stabilizer leg member through a member extending between the second stabilizer leg member and the shaft transversally to the longitudinal extension of the stabilizer leg. Hereby, the shaft will be subjected to a movement in relation to the first stabilizer leg member when the second stabilizer leg member is moved in relation to the first stabilizer leg member.

According to another embodiment of the invention said guiding members are arranged on one hand on a member to be fixedly secured to or being a part of said object and on the other hand on the shaft.

According to another embodiment of the invention the guiding members do then comprise first guiding members in the form of wall members providing opposite walls defining a path extending vertically when the object is resting on horizontal ground and the device is in working position and a second guiding member with a width corresponding to the width of said path and configured to be guided by the walls when moved in the path upon extension and retraction of the stabilizer leg with the second stabilizer leg member being extended beyond said predetermined extension degree, and a first one of said wall members has a design configured to co-operate with a design of the second guiding member so as to remove the guiding action upon the shaft by this first wall member when the shaft is in a position obtained by a retraction of said second stabilizer leg member to the position of said predetermined extension degree.

Said co-operation of the design of the first wall member and that of said second guiding member is then according to another embodiment of the invention configured to allow pivoting of the stabilizer leg, and by that of the shaft, into a position of vertical extension when the object is resting on horizontal ground in an extension movement of the second stabilizer leg member towards said position of predetermined extension degree. The vertical extension of the stabilizer leg to be assumed thereby in the working position is obtained by these features.

According to another embodiment of the invention the second one of said wall members on the opposite side of said path in relation to the first wall member is designed to form an obstacle against pivoting of the shaft in one direction about an axis in parallel with said horizontal axis when the second stabilizer leg member is in said position of predetermined extension degree. This means that the stabilizer leg may never pivot in the "wrong" direction and may not pass the position in which it has a vertical extension when pivoting towards this position since it is stopped in this position.

According to another embodiment of the invention the shaft is provided with said first guiding members by having a slot forming said path, the second guiding member is formed by a ridge arranged on the member to be fixedly secured to or being a part of said object, and said first wall member is designed to reach, by a lower end thereof, an upper end of said ridge in said position of a predetermined extension degree of the second stabilizer leg member allowing pivoting of the shaft, and by that of the second stabilizer leg member, in the direction of said second wall member designed to in this position still extend along a part of said ridge for preventing pivoting of the shaft in the opposite direction. This constitutes one possible way of obtaining said path.

Another way of obtaining said path is according to another embodiment of the invention accomplished by arranging said first guiding members on the member to be fixedly secured to or being a part of said object and forming the second guiding member by the shaft received between the wall members forming said path. In a further development of this embodiment a portion of the shaft is provided with a recess of a size able to receive said first wall member and by that enable pivoting of the shaft by allowing the first wall member to enter the recess on one side of the shaft and exit the recess on the opposite side of the shaft.

According to another embodiment of the invention said power member is a power cylinder with a first stabilizer leg member providing the cylinder chamber of the power cylinder and the second stabilizer leg member forming a piston rod of the power cylinder, wherein the power member may be a hydraulic cylinder.

The invention also relates to a support arrangement and a movable crane construction according to the description herein. The advantages of such an arrangement and such a construction appear clearly from the above discussion of the stabilizer leg device according to the present invention.

Further advantages as well as advantageous features of the invention will appear from the description following below.

BRIEF DESCRIPTION OF THE DRAWINGS

With reference to the appended drawings, below follows a specific description of embodiments of the invention cited as examples.

In the drawings.

DETAILED DESCRIPTION OF AN EMBODIMENT OF THE INVENTION

Figure 1:
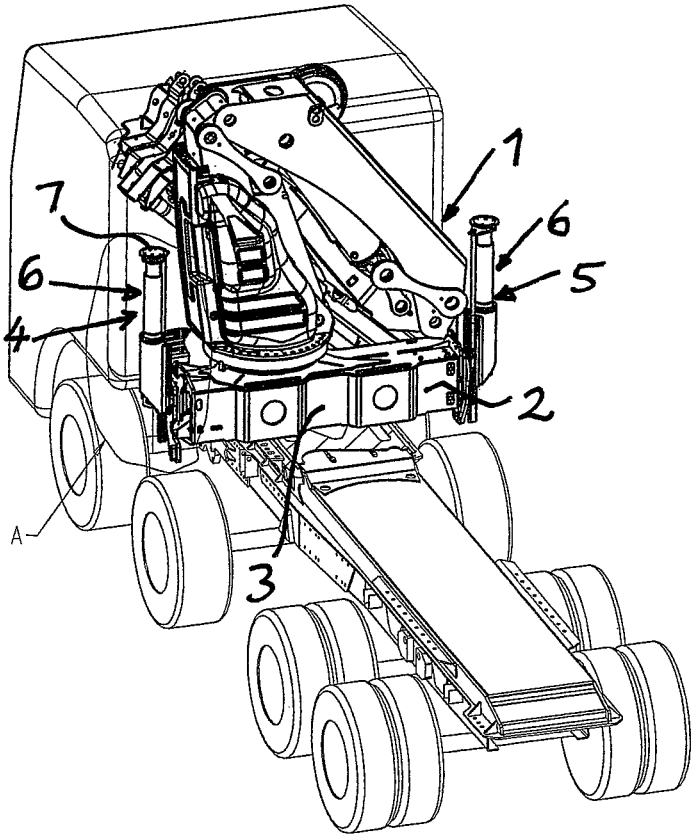
FIG. 1 is a schematic view of a crane vehicle provided with two stabilizer leg devices according to the invention in an inactive state.
Figure 2:
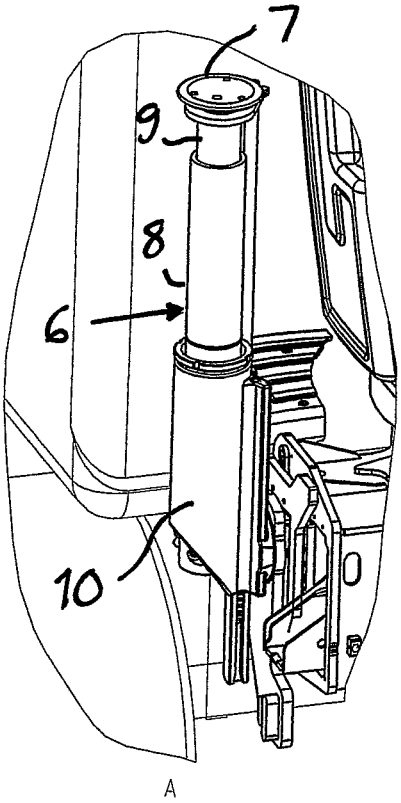
FIG. 2 is an enlarged view of a part of the crane vehicle shown in FIG. 1 showing one stabilizer leg device in said inactive state more in detail.
Figure 3:
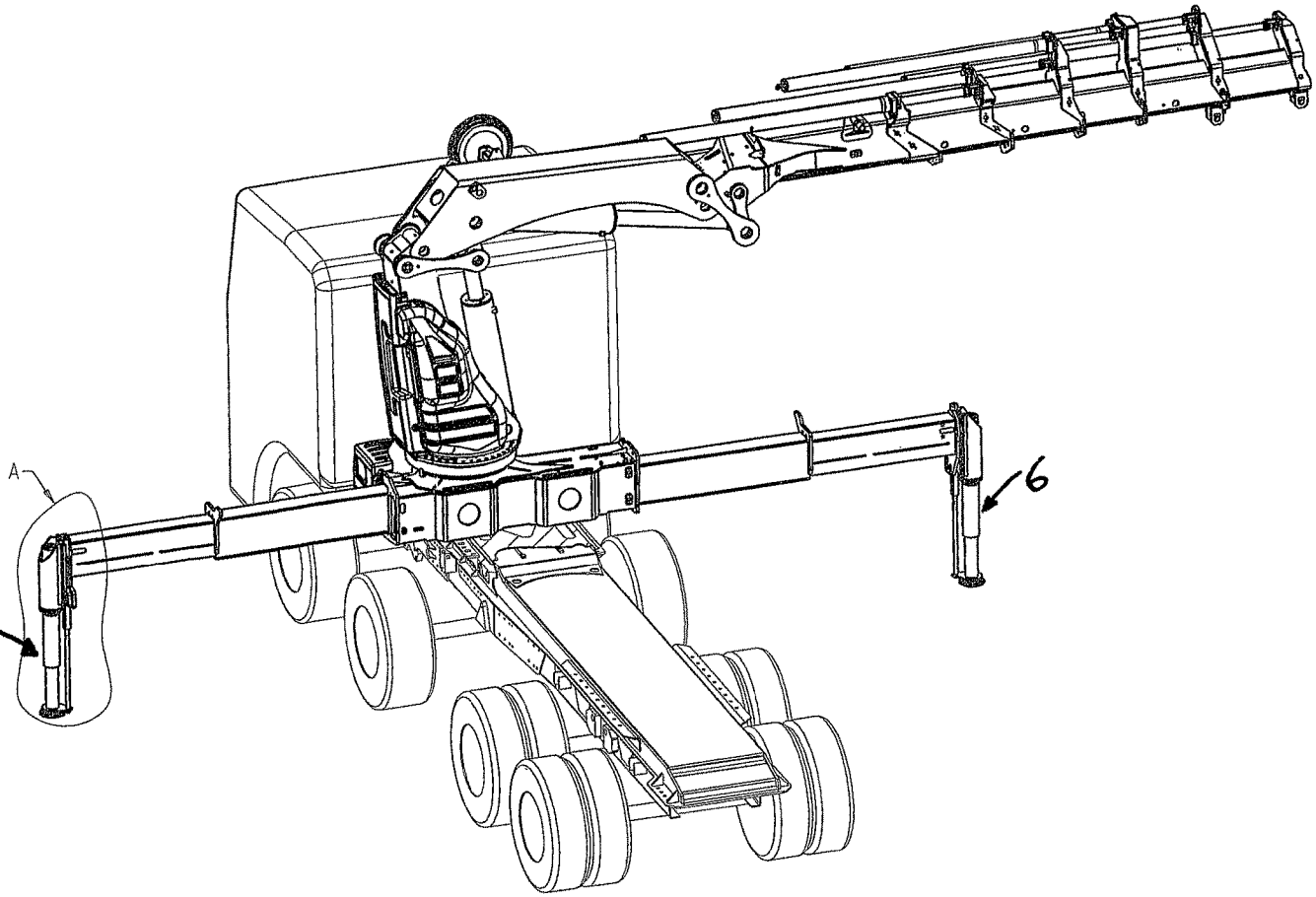
FIG. 3 is a view of the crane vehicle in FIG. 1 with the two stabilizer leg devices in a working position stabilizing the vehicle by bearing through a footplate onto the ground.
Figure 4:
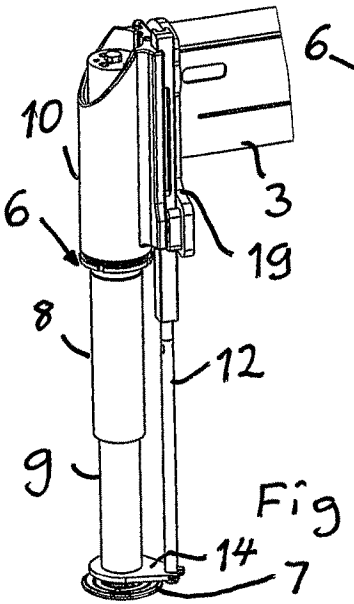
FIG. 4 is an enlarged view of a part of the crane vehicle shown in FIG. 1 showing one stabilizer leg device in a working position more in detail.

FIG. 1 shows schematically an object 1 in the form of a crane vehicle to which a support arrangement 2 is fixed by having a frame structure 3 thereof fixed to the framework of the vehicle. The support arrangement is provided with two stabilizer leg devices 4, 5 according the present invention. Each stabilizer leg device has a stabilizer leg 6 to be moved downwards from the crane vehicle while being extended (prolonged) and tilted by 180° from the parking position shown in FIG. 1 so as to stabilize the crane vehicle by bearing through a foot plate 7 secured to a lower end of the stabilizer leg onto the ground on which the vehicle is resting in a working position of the stabilizer leg device, as shown in FIG. 3. FIGS. 2 and 4 are enlarged views showing how a stabilizer leg 6 is arranged on the support arrangement 2 in the parking position and in the working position, respectively, of the stabilizer leg device.

The design and function of a stabilizer leg device according to this embodiment of the invention will now be described with reference to FIGS. 1-10. The stabilizer leg 6 is formed by a power member of the length varying type in the form of a power cylinder with a first stabilizer leg member 8 providing the cylinder chamber of the power cylinder and a second stabilizer leg member 9 forming a piston rod of the power cylinder and to an end of which the foot plate 7 is secured. The power cylinder is preferably a hydraulic cylinder. The first stabilizer leg member 8 is secured in a holder 10, which in its turn is pivotally connected to the frame structure 3 of the support arrangement 2 so as to be pivotable about an axis 11 which is horizontal when the crane vehicle is resting on horizontal ground. By being secured in the holder 10, the first stabilizer leg member 8 is pivotally connected to the frame structure 3 of the support arrangement 2 so as to be pivotable in relation to the frame structure 3 about said axis 11. The stabilizer leg 6 may by that be tilted about an axis 11 which is perpendicular to the extension of the stabilizer leg.

A shaft 12 has a second end 13 connected to the second stabilizer leg member 9 through a member 14 extending transversely to the longitudinal extension of the stabilizer leg 6. The holder 10 is designed to receive and hold a first end 15 of the shaft 12 displaceably in parallel with the longitudinal extension of the stabilizer leg 6 while keeping the shaft 12 in parallel with the stabilizer leg.

The shaft 12 is a part of an arrangement of the stabilizer leg device configured to control the stabilizer leg to be moved between the parking position shown in FIG. 1 and the working position shown in FIG. 3. This arrangement further comprises first guiding members 16, 17 in the form of wall members providing opposite walls defining a path 18 extending vertically when the object is resting on horizontal ground. These first guiding members 16, 17 are arranged on a plate member 19 to be fixedly secured to the frame structure 3 of the support arrangement 2 and by that to the crane vehicle 1. A second guiding member of the arrangement is formed by the shaft 12 itself. The guiding members of the arrangement co-operates in order to achieve the movement of the stabilizer leg between the working position and the parking position, as described further below.

The arrangement further comprises a first engagement member 20 in the form of a gearwheel which is fixed in relation to the frame structure 3 by being fixed to the plate member 19 and which is arranged coaxially to the horizontal axis 11. The shaft 12 is provided with a second engagement member by having a cogged part 21. This cogged part 21 is arranged on the shaft 12 to reach and enter into engagement with the cogs of the gearwheel 20 in a predetermined position of the stabilizer leg reached upon retraction of the second stabilizer leg member 9 from the working position shown in FIG. 4 to the position shown in FIG. 7. The two first guiding members 16, 17 will guide the shaft 12 to be displaced vertically when moving from the position shown in FIG. 6 to the position shown in FIG. 7. A portion of the shaft is provided with a recess 22 (see FIG. 8) of a size able to receive a first one 16 of the wall members and by that enable pivoting of the shaft 12 by allowing the first wall member 16 to enter the recess on one side of the shaft and exit the recess on the opposite side of the shaft. The recess 22 is located to be aligned with the first wall member 16 in said predetermined position shown in FIG. 7. The second wall member 17 is larger than the first wall member 16 and is of such a size that it is not able to enter the recess 22 in the shaft 12.

Figure 9:
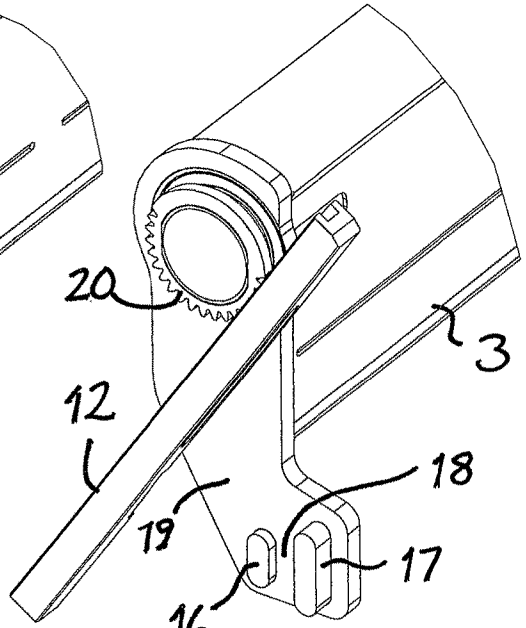
FIGS. 8 and 9 are enlarged views illustrating pivoting of the shaft and by that the stabilizer leg in relation to the crane vehicle by means of engagement members.

The function of the stabilizer leg device according to the invention will be as follows. When starting from the working position, the second stabilizer leg member 9 will be retracted into the first stabilizer leg member 8 and the stabilizer leg will through this retraction move to the parking position shown in FIG. 2 and FIG. 10. When the second stabilizer leg member 9 is retracted to said predetermined position corresponding to FIG. 7 the cogged part 21 of the shaft 12 will enter into engagement with the cogs of the gearwheel 20. During further retraction of the second stabilizer leg member 9 and by that further displacement of the shaft 12 upwards, the engagement between the cogged part 21 of the shaft 12 and the gearwheel 20 will cause the shaft 12, and thereby the entire stabilizer leg 6, to pivot about the centre axis of the gearwheel, which coincides with the above-mentioned horizontal axis 11. The pivoting of the shaft 12 is enabled in that the recess 22 in the shaft makes it possible for the shaft 12 to pass over the first wall member 16, as illustrated in FIG. 8. Thus, the shaft 12 will through said retraction move around the gearwheel 20 as shown in FIGS. 8 and 9 to finally reach the parking position shown in FIG. 10 upon retraction of the second stabilizer leg member 9 and by that shortening of the stabilizer leg 6.

Figure 7:
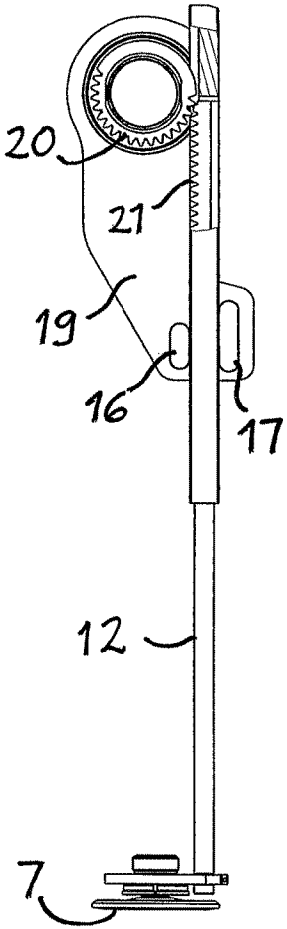
FIG. 7 is a view corresponding to FIG. 6 for the stabilizer leg retracted from the working position but still having a vertical extension.
Figure 6:
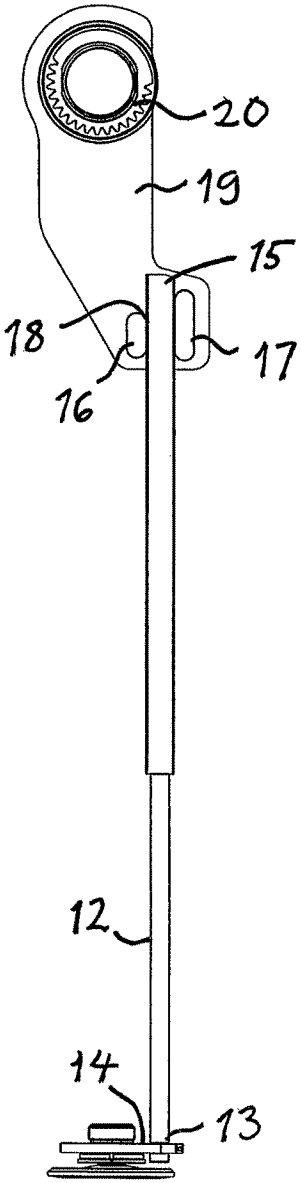
FIG. 6 is a simplified view of parts of the stabilizer leg device shown in FIG. 5 in said working position.
Figure 5:
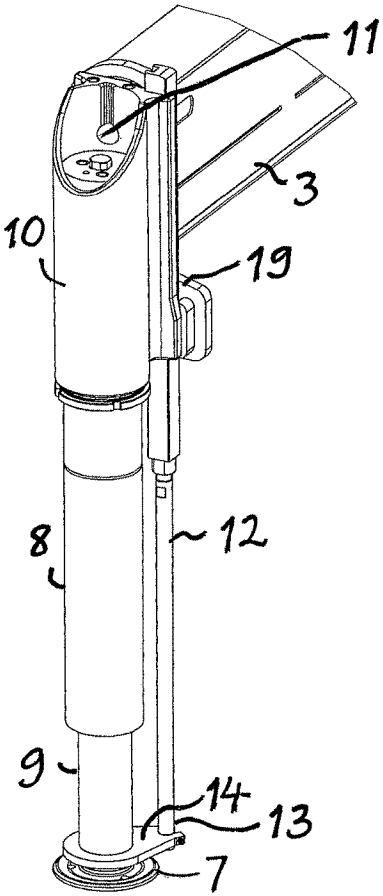
FIG. 5 is a perspective view of a stabilizer leg device according to an embodiment of the invention in said working position.
Figure 10:
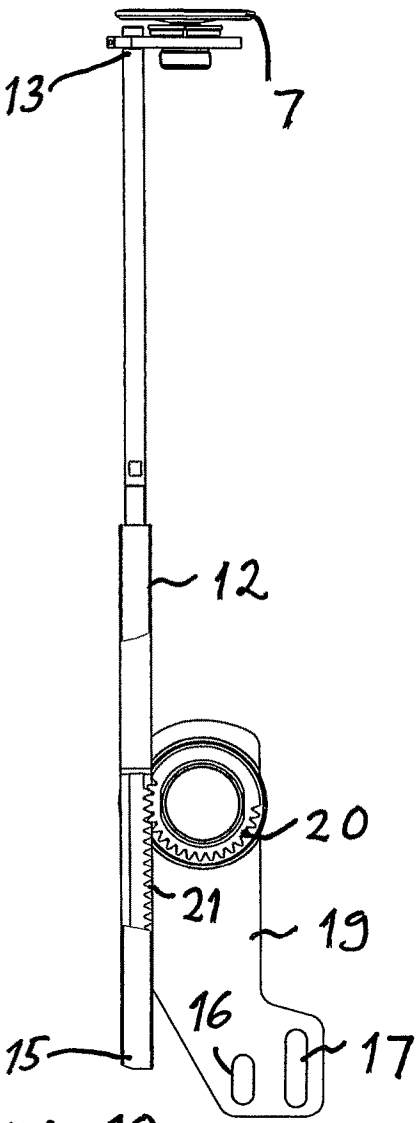
FIG. 10 is a view corresponding to FIGS. 6 and 7 for the staposition obtained after pivoting 180° from the working position shown in FIG. 6.
Figure 8:
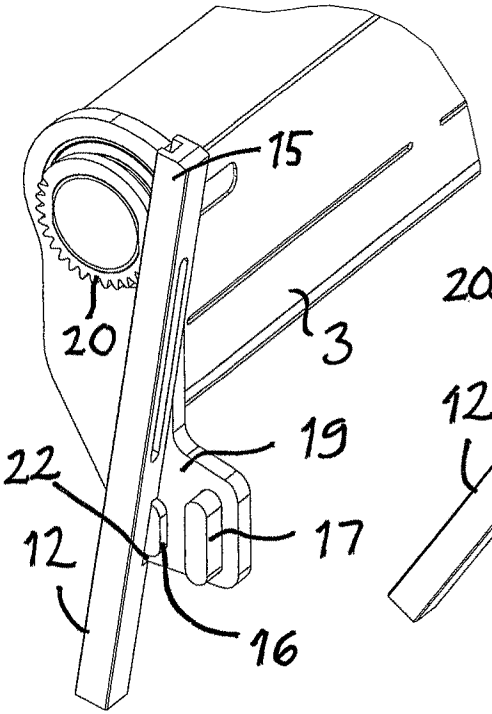

When instead transferring the stabilizer leg device from the parking position shown in FIG. 2 to the working position shown in FIG. 4, the power member (stabilizer leg) is controlled to extend the second stabilizer leg member 9 in relation to the first stabilizer leg member 8, which will cause the cogged part 21 of the shaft 12 to move around the gearwheel 20 while pivoting the stabilizer leg 6 towards said predetermined position shown in FIG. 7. Prior to reaching this position, the recess 22 of the shaft 12 will move over the first wall member 16 and when reaching said predetermined position the shaft 12 is prevented by the second wall member 17 from pivoting further. Further extension of the second stabilizer leg member 9 will result in a displacement of the stabilizer leg member 9 in the direction of the longitudinal extension thereof controlled by the guiding of the shaft 12 in the path 18 provided by the guiding members 16, 17. Accordingly, the stabilizer leg will through the co-operation of the shaft 12 with the guiding members 16, 17 automatically be locked to have a vertical extension when being extended further in relation to said predetermined position shown in FIG. 7. Conversely, this locking action will automatically be interrupted when the stabilizer leg reaches said predetermined position shown in FIG. 7 upon retraction of the second stabilizer leg member 9 and by that shortening of the stabilizer leg 6.

The invention is of course in no way restricted to the embodiment described above, since many possibilities for modifications thereof are likely to be obvious to a person skilled in the art without having to deviate from the scope of the invention defined in the appended claims.

The object to be stabilized by a device according to the invention may be any type of object needing such a stabilization to stand safely without moving or any risk to tilt.

Although not shown, the shaft may provide the first guiding members through a slot therein, wherein the second guiding member moving in said path provided by the slot is formed by a ridge which is fixed in relation to said object, such as a crane vehicle.

The invention claimed is:

1. A stabilizer leg device with a stabilizer leg (6) to be moved downwards from an object (1), such as a crane vehicle, to stabilise this object by bearing through a footplate (7) secured to a lower end of the stabilizer leg onto a support layer on which the object is resting, said device comprising:

a power member of the length varying type forming the stabilizer leg (6) and configured to have a first stabilizer leg member (8) thereof pivotally connecting an end of the stabilizer leg to said object about a horizontal axis (11) when the object is resting on horizontal ground and a second stabilizer leg member (9) provided with the footplate and extendable and retractable in relation to the first stabilizer leg member in a direction perpendicular to said horizontal axis for length variation of the stabilizer leg; and an arrangement configured to control the stabilizer leg (6) to be moved from a working position of the stabilizer leg device with the footplate (7) bearing on the ground to a parking position in which the footplate points upwards upon a retraction of the second stabilizer leg member (9) in relation to the first stabilizer leg member (8) causing a pivoting of the first stabilizer leg member, and of the stabilizer leg (6), about said horizontal axis (11), and from the parking position to the working position upon extension of the second stabilizer leg member (9) in relation to the first stabilizer leg member (8), said arrangement comprising a first engagement member (20) configured to be arranged coaxially to said horizontal axis (11) on a part (19) which is fixed in relation to said object, and a shaft (12) having a first end (15) provided with a second engagement member (21) and an opposite second end (13) arranged to be influenced by movement of the second stabilizer leg member (9) in relation to the first stabilizer leg member (8) to make the shaft (12) slide along the stabilizer leg (6) under said extension and retraction of the stabilizer leg to cause pivoting of the stabilizer leg by engagement of said second engagement member (21) with said first engagement member (20) during extension and retraction of the stabilizer leg, wherein said arrangement comprises guiding members (16, 17) configured to, in said working position of the stabilizer leg device and upon retraction of the stabilizer leg (6) therefrom to a position of predetermined extension degree of said second stabilizer leg member (9) in relation to the first stabilizer leg member (8), prevent pivoting of the stabilizer leg about said horizontal axis (11) by guiding said shaft (12) to slide vertically, and upon reaching said predetermined position to interrupt said guiding and allow the stabilizer leg (6) to pivot about said horizontal axis (11), and said second engagement member (21) is positioned on said shaft to enter into engagement with the first engagement member (20) when the second stabilizer leg member (9) is reaching said predetermined position in a stabilizer leg retraction movement and to leave said engagement when reaching said predetermined position in a stabilizer leg extension movement to automatically unlock and lock, respectively, the stabilizer leg (6) with respect to possibility to pivot about said horizontal axis (11) by passing said predetermined position by the second stabilizer leg member (9).

2. A stabilizer leg device according to claim 1, wherein said first engagement member (20) comprises an at least semi-circular member, such as a disc, which is fixed to said part (19) coaxially to said horizontal axis (11) and provided with cogs over at least a part of its circumference, and the shaft (12) is provided with said second engagement member (21) by being at least partially cogged to engage with the cogs of the first engagement member.

3. A stabilizer leg device according to claim 2, wherein the cogs of the first engagement member are provided by a disc in the form of a gearwheel (20) provided with cogs over at least a part of the circumference thereof.

4. A stabilizer leg device according to claim 1, wherein said second end (13) of the shaft (12) is connected to the second stabilizer leg member (9) through a member (14) extending between the second stabilizer leg member (9) and the shaft (12) transversely to the longitudinal extension of the stabilizer leg (6).

5. A stabilizer leg device according to claim 1, wherein said guiding members are arranged on one hand on a member (19) to be fixedly secured to or being a part of said object and on the other hand on the shaft (12).

6. A stabilizer leg device according to claim 5, wherein said guiding members comprise first guiding members (16, 17) in the form of wall members providing opposite walls defining a path (18) extending vertically when the object is resting on horizontal ground and the device is in working position and a second guiding member (12) with a width corresponding to the width of said path and configured to be guided by the walls when moved in the path upon extension and retraction of the stabilizer leg (6) with the second stabilizer leg member (9) being extended beyond said predetermined extension degree, and a first one (16) of said wall members has a design configured to co-operate with a design of the second guiding member (12) to remove the guiding action upon the shaft by this first wall member when the shaft is in a position obtained by a retraction of said second stabilizer leg member to the position of said predetermined extension degree.

7. A stabilizer leg device according to claim 6, wherein said co-operation of the design of the first wall member (16) and of said second guiding member (12) is configured to allow pivoting of the stabilizer leg (6), and of the shaft (12), into a position of vertical extension when the object is resting on horizontal ground in an extension movement of the second stabilizer leg member (9) towards said position of predetermined extension degree.

8. A stabilizer leg device according to claim 6, wherein a second one (17) of said wall members on the opposite side of said path (18) in relation to the first wall member (16) is designed to form an obstacle against pivoting of the shaft (12) in one direction about an axis in parallel with said horizontal axis (11) when the second stabilizer leg member (9) is in said position of predetermined extension degree.

9. A stabilizer leg device according to claim 6, wherein the shaft (12) is provided with said first guiding members by having a slot forming said path, the second guiding member is formed by a ridge arranged on the member to be fixedly secured to or being a part of said object, and said first wall member is designed to reach, by a lower end thereof, an upper end of said ridge in said position of a predetermined extension degree of the second stabilizer leg member allowing pivoting of the shaft, and of the second stabilizer leg member, in the direction of said second wall member designed to in this position still extend along a part of said ridge for preventing pivoting of the shaft in the opposite direction.

10. A stabilizer leg device according to claim 6, wherein said first guiding members (16, 17) are arranged on the member (19) to be fixedly secured to or being a part of said object and the second guiding member is formed by the shaft (12) received between the wall members forming said path (18).

11. A stabilizer leg device according to claim 10, wherein a portion of the shaft is provided with a recess (22) of a size able to receive said first wall member (16) and enable pivoting of the shaft (12) by allowing the first wall member to enter said recess on one side of the shaft and exit the recess on the opposite side of the shaft.

12. A stabilizer leg device according to claim 1, wherein said power member is a power cylinder with the first stabilizer leg member (8) providing the cylinder chamber of the power cylinder and the second stabilizer leg member (9) forming a piston rod of the power cylinder.

13. A stabilizer leg device according to claim 12, wherein the power member is a hydraulic cylinder.

14. A support arrangement configured to be fixed to an object, such as a crane vehicle, so as to give this object (1) support from a support layer on which the object is resting, wherein the arrangement (2) comprises a frame structure (3) configured to be fixed to said object and at least one stabilizer leg device (4, 5) according to claim 1 secured to the frame structure.

15. A movable crane construction, such as a crane vehicle, comprising a support arrangement (2) according to claim 14.

16. A stabilizer leg device according to claim 3, wherein said second end (13) of the shaft (12) is connected to the second stabilizer leg member (9) through a member (14) extending between the second stabilizer leg member (9) and the shaft (12) transversely to the longitudinal extension of the stabilizer leg (6).

17. A stabilizer leg device according to claim 2, wherein said second end (13) of the shaft (12) is connected to the second stabilizer leg member (9) through a member (14) extending between the second stabilizer leg member (9) and the shaft (12) transversely to the longitudinal extension of the stabilizer leg (6).

18. A stabilizer leg device according to claim 17, wherein said guiding members are arranged on one hand on a member (19) to be fixedly secured to or being a part of said object and on the other hand on the shaft (12).

19. A stabilizer leg device according to claim 16, wherein said guiding members are arranged on one hand on a member (19) to be fixedly secured to or being a part of said object and on the other hand on the shaft (12).

20. A stabilizer leg device according to claim 4, wherein said guiding members are arranged on one hand on a member (19) to be fixedly secured to or being a part of said object and on the other hand on the shaft (12).

* * * * *